US007222681B2

(12) United States Patent
Jones et al.

(10) Patent No.: US 7,222,681 B2
(45) Date of Patent: May 29, 2007

(54) PROGRAMMING METHOD FOR CONTROLLING A DOWNHOLE STEERING TOOL

(75) Inventors: Stephen Jones, Cypress, TX (US); Junichi Sugiura, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 311 days.

(21) Appl. No.: 11/062,299

(22) Filed: Feb. 18, 2005

(65) Prior Publication Data

US 2006/0185900 A1 Aug. 24, 2006

(51) Int. Cl.
*E21B 44/00* (2006.01)
*E21B 7/04* (2006.01)

(52) U.S. Cl. ..... 175/38; 175/45; 175/48; 175/61; 702/9; 73/152.21; 73/152.43

(58) Field of Classification Search ..... 175/26, 175/38, 45, 48, 61, 62, 325.1, 325.3, 325.5; 702/9; 340/853.4, 853.6; 73/152.18, 152.19, 73/152.21, 152.22, 152.29, 152.31, 152.34, 73/152.43, 152.52

See application file for complete search history.

(56) References Cited

U.S. PATENT DOCUMENTS

| | | | | |
|---|---|---|---|---|
| 3,298,449 | A | 1/1967 | Bachman et al. | |
| 4,354,233 | A | 10/1982 | Zhukovsky et al. | |
| 4,655,299 | A | 4/1987 | Schoeffler | |
| 4,903,245 | A * | 2/1990 | Close et al. | 340/853.3 |
| 5,065,825 | A | 11/1991 | Bardin et al. | |
| 5,603,386 | A | 2/1997 | Webster | |
| 6,021,377 | A * | 2/2000 | Dubinsky et al. | 702/9 |
| 6,267,185 | B1 | 7/2001 | Mougel et al. | |
| 6,662,110 | B1 * | 12/2003 | Bargach et al. | 702/6 |
| 7,114,579 | B2 * | 10/2006 | Hutchinson | 175/40 |
| 7,142,986 | B2 * | 11/2006 | Moran | 702/9 |
| 7,172,037 | B2 * | 2/2007 | Dashevskiy et al. | 175/25 |
| 2004/0217879 | A1 | 11/2004 | Guggari et al. | |
| 2005/0001737 | A1 | 1/2005 | Baron et al. | |

FOREIGN PATENT DOCUMENTS

| | | |
|---|---|---|
| GB | 2172324 | 7/1986 |
| GB | 2177738 | 1/1987 |
| GB | 2282165 | 3/1995 |
| GB | 2356207 A | 5/2001 |
| GB | 2358651 A | 8/2001 |
| WO | WO-90/07625 | 7/1990 |
| WO | WO-90/08245 | 7/1990 |
| WO | WO-01-01191 A1 | 2/2001 |

* cited by examiner

*Primary Examiner*—Kenneth Thompson

(57) ABSTRACT

A method for communicating with a downhole tool located in a subterranean borehole is disclosed. Exemplary embodiments of the method include encoding data and/or commands in a sequence of varying drill string rotation rates and drilling fluid flow rates. The varying rotation rates and flow rates are measured downhole and processed to decode the data and/or the commands. In one exemplary embodiment, commands in the form of relative changes to current steering tool offset and tool face settings are encoded and transmitted downhole. Such commands may then be executed, for example, to change the steering tool settings and thus the direction of drilling. Exemplary embodiments of this invention advantageously provide for quick and accurate communication with a downhole tool.

31 Claims, 6 Drawing Sheets

500

START
502
STATE=0
RESET TIMER
BASE=RATE
504
IS RATE WITHIN 20 RPM OF BASE?
NO
YES
506
TIMER ≥ 60?
NO
YES
508
FLOW RATE HIGH?
NO
YES-REFERENCE RATE OF ROTATION IS ESTABLISHED
510
STATE = 1
RATE>BASE+20?
YES
512
NO
RATE<BASE-20?
NO
514
YES
FROM FIG. 5C
D
DELAY 30 SECONDS
516
STATE = 2
518
520
RATE<10 RPM?
NO
YES
521
FLOW RATE LOW?
NO
YES
522
BASE>30 RPM?
NO
YES
FROM FIG. 5B,5C
B
STATE = 3
524
RESET TIMER
526
RATE<10 RPM?
NO
528
YES
TIMER≥30?
NO
530
YES
A
TO FIG. 5B

FROM FIG. 5A
A
532
STATE = 4
534
RATE≥10 RPM?
NO
YES
536
STATE = 5
538
DELAY 40 SECONDS
RATE≥30 RPM?
YES
540
NO
500

STATE = 6
542
RESET TIMER
544
RPM(i)=RATE
546
548
RATE WITHIN 30 RPM OF RPM(1) ?
NO
YES
550
TIMER>150 SECONDS?
YES
NO
RATE<30 RPM?
NO
YES
552
TIMER>30 SECONDS?
NO
YES
554
B
TO FIG. 5A
C
TO FIG. 5C

500

PROGRAMMING METHOD FOR CONTROLLING A DOWNHOLE STEERING TOOL

RELATED APPLICATIONS

None.

FIELD OF THE INVENTION

The present invention relates generally to a method of communicating information from the surface to a downhole device located in a subterranean borehole. More particularly, exemplary embodiments of this invention relate to a method of encoding tool commands in a combination of drill string rotation rate and drilling fluid flow rate variations. Exemplary embodiments of the invention also relate to a differential programming method in which relative changes to current tool parameters are encoded.

BACKGROUND OF THE INVENTION

Oil and gas well drilling operations commonly use sensors deployed downhole as a part of the drill string to acquire data as the well bore is being drilled. This real-time data may provide information about the progress of the drilling operation or the earth formations surrounding the well bore. Significant benefit may be obtained by improved control of downhole sensors from the rig floor or from remote locations. For example, the ability to send commands to downhole sensors that selectively activate the sensors can conserve the battery life of the sensors and increase the amount of downhole time a sensor is useful.

Directional drilling operations are particularly enhanced by improved control. The ability to efficiently and reliably transmit commands from an operator to downhole drilling hardware may enhance the precision of the drilling operation. Downhole drilling hardware that, for example, deflects a portion of the drill string to steer the drilling tool is typically more effective when under tight control by an operator. The ability to continuously adjust the projected direction of the well path by sending commands to a steering tool may enable an operator to fine tune the projected well path based on substantially real-time survey data. In such applications, both accuracy and timeliness of data transmission are clearly advantageous.

Prior art communication techniques that rely on the rotation rate of the drill string to encode data are known. For example, Webster, in U.S. Pat. No. 5,603,386, discloses a method in which the absolute rotation rate of the drill string is utilized to encode data. While the Webster technique is serviceable, improvements could be made. For example, the optimum rotation rate of the drill string may vary within an operation, or from one operation to the next, depending on the type of drill bit being used and the strata being penetrated. As such, frequent reprogramming of the absolute rotation rates is sometimes required.

U.S. Patent Application 20050001737, to Baron et al., which is commonly assigned with the present application, discloses another technique for encoding data that also relies on the rotation rate of the drill string. The Baron technique advantageously overcomes the above-described difficulty, for example, by utilizing a difference between first and second rotation rates to encode data. While this approach is serviceable it may be improved upon for certain downhole applications. For example, drilling applications may be encountered in which the drill string sticks and/or slips in the borehole. This is a condition commonly referred to in the art as stick/slip, and is known to cause a non-uniform drill string rotation rate. In stick/slip situations, precise measurement of the drill string rotation rate sometimes becomes problematic. Therefore, there exists a need for improved techniques for communicating from the surface to a downhole tool.

SUMMARY OF THE INVENTION

The present invention addresses one or more of the above-described drawbacks of prior art downhole communication methods. Aspects of this invention include a method for communicating with a downhole tool, such as a downhole steering tool, that is connected to a drill string and deployed in a subterranean borehole. Exemplary embodiments of the method include encoding data and/or commands in a sequence of varying drill string rotation rates and drilling fluid flow rates. The varying rotation rates and flow rates are measured downhole and processed to decode the data and/or the commands. In one exemplary embodiment, commands in the form of relative changes to steering tool offset and tool face settings are encoded and transmitted downhole. Such commands may then be executed, for example, to change the steering tool settings and thus the direction of drilling the borehole.

Exemplary embodiments of the present invention may advantageously provide several technical advantages. For example, exemplary methods according to this invention provide for quick and accurate communication with a downhole tool, such as a sensor or a downhole drilling tool. In particular, the use of both rotation rate and flow rate encoding tends to provide for increased bandwidth as compared to prior art encoding methods. Moreover, the use of a differential encoding scheme, in which a relative change in the value of a tool parameter is encoded, may also be advantageous. Such a differential approach tends to reduce the quantity of encoded information and thereby may further reduce transmission time as compared to the prior art.

The use of a differential encoding scheme may also be advantageous in that it tends to require fewer distinct commands than direct programming methods of the prior art. As such, fewer rotation rate and/or flow rate levels are required to encode those commands, which tends to increase accuracy by decreasing the likelihood of transmitting erroneous commands. Moreover, having fewer rotation rate levels may be advantageous in certain applications in which accurate measurement of the rotation rate is problematic (e.g., in stick/slip situations, as described above).

Exemplary embodiments of this invention may be further advantageous in that surface to downhole communication may be accomplished without substantially interrupting the drilling process. Rather, data and/or commands may be encoded in drill string rotation rate and drilling fluid flow rate variations and transmitted downhole during drilling. Additionally, the present invention may advantageously be utilized at substantially any conventional rotation rate being employed to drill a borehole. As such, the invention tends to be suitable for use with substantially any drilling rig configuration without the need for reprogramming and/or reconfiguration of the command parameters.

In one aspect the present invention includes a method for communicating with a downhole tool deployed in a subterranean borehole. The method includes deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis, the drill string further including a flow measurement device operative to measure flow rates of drilling fluid in the drill string. The method further includes predefining an encoding language comprising codes understandable to the downhole device, the codes represented in said language as predefined value combinations of drill string rotation variables and drilling fluid flow variables, the drill string rotation variables including rotation rate, the drilling fluid flow variables including flow rate. The method still further includes causing the drill string to rotate at a preselected rotation rate, causing the drilling fluid to flow in the drill string at a preselected flow rate, and causing the rotation measurement device to measure the rotation rate and the flow measurement device to measure the flow rate. The method yet further includes processing downhole the measured rotation rate and flow rate to acquire at least one code in said language at the downhole tool.

In another exemplary aspect the present invention includes a method for communicating with a downhole tool deployed in a subterranean borehole. The method includes deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis. The method further includes predefining an encoding language comprising codes understandable to the steering tool, the codes represented in said language as predefined value combinations of drill string variables including drill string rotation variables, said drill string rotation variables including rotation rate. The method still further includes causing the drill string to rotate at a preselected rotation rate and causing the rotation measurement device to measure the rotation rate. The method also includes processing downhole the measured rotation rate to acquire at least one code in said language at the downhole tool, the downhole tool recognizing at least one of said acquired codes as a command to make a predetermined relative change to at least one of its current tool settings.

In still another aspect the present invention includes a method for communicating with a downhole tool deployed in a subterranean borehole. The method includes deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis, the drill string further including a flow sensing device operative to measure flow of drilling fluid in the drill string. The method further includes predefining an encoding language comprising codes understandable to the downhole device, the codes represented in said language as predefined value combinations of drill string rotation variables and drilling fluid flow variables, the drill string rotation variables including rotation rate. The method still further includes causing the drill string to rotate at a preselected rotation rate, causing the drilling fluid to flow in the drill string at a preselected flow rate, causing the rotation measurement device to measure the rotation rate of the drill string, and causing the flow sensing device to measure the flow of the drilling fluid, the flow measured as a binary variable including high and low flow levels. The method also includes processing downhole the measured rotation rate and the measured flow to acquire at least one code in said language at the downhole tool, the at least one code acquired at the tool only when the measured flow is detected to be at a preselected one of the high and low flow levels.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
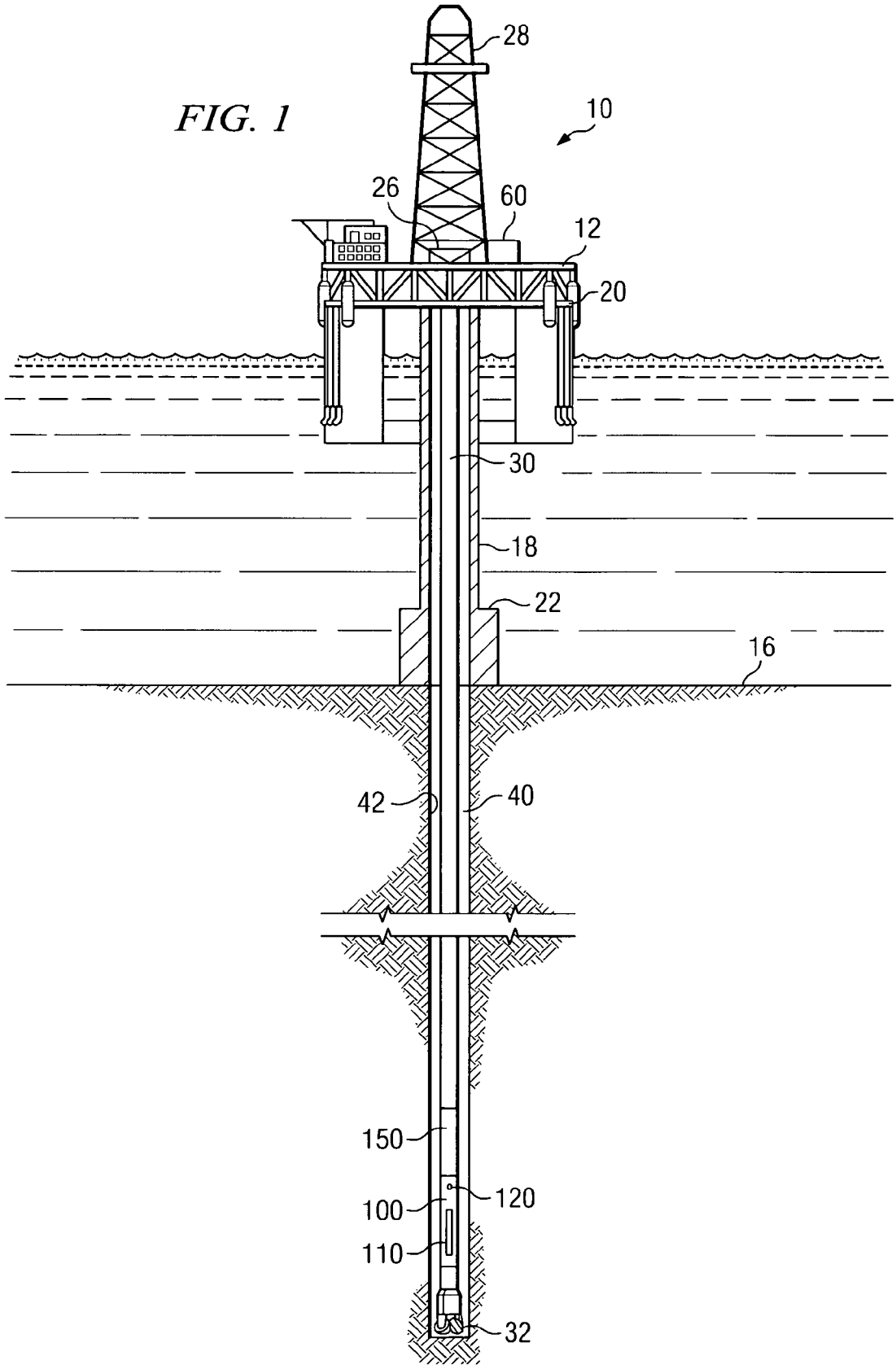
FIG. 1 depicts a drilling rig on which exemplary embodiments of the present invention may be deployed.

FIG. 1 illustrates a drilling rig 10 suitable for utilizing exemplary embodiments of the present invention. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a directional drilling tool 100 (such as a three dimensional rotary steerable tool). Rig 10 further includes a transmission system 60 for controlling, for example, the rotation rate of drill string 30 and the flow rate of drilling fluid in drill string 30. Such devices may be computer controlled or manually operated as described in more detail below. The invention is not limited in this regard.

In the exemplary embodiment shown, directional drilling tool 100 includes one or more (e.g., three) blades 110 disposed to extend from directional drilling tool 100 and apply a lateral force and/or displacement to the borehole wall 42 in order to deflect the drill string 30 from the central axis of the borehole 40 and thus change the drilling direction. Directional drilling tool 100 further includes one or more sensors 120 for measuring, for example, the rotation rate of the drill string 30 and the flow rate of drilling fluid in the drill string 30. Sensors 120 may alternatively be deployed elsewhere in the drill string 30. Drill string 30 may further include a measurement while drilling (MWD) tool 150 including one or more surveying sensors, such as accelerometers, magnetometers, and/or gyroscopes. Drill string 30 may further include substantially any other downhole tools coupled thereto, such as logging while drilling (LWD) tools, formation sampling tools, a telemetry system for communicating with the surface, and the like.

It will be understood by those of ordinary skill in the art that methods in accordance with this invention are not limited to use with a semisubmersible platform 12 as illustrated in FIG. 1. This invention is equally well suited for use with any kind of subterranean drilling operation, either offshore or onshore. Moreover, it will also be understood that methods in accordance with this invention are not limited to communication with a directional drilling tool 100 as illustrated in FIG. 1. The invention is also well suited for communicating with substantially any other downhole tools, including, for example, LWD and MWD tools and other downhole sensors. For example, aspects of this invention may be utilized to transmit commands and/or changes in commands from the surface to activate or deactivate a sensor. Additionally, certain aspects of this invention may be utilized in combination with other techniques (such as mud pulse telemetry). Such a combination of techniques may provide enhanced functionality, for example, in directional drilling applications in which data from various downhole sensors may be analyzed at the surface and used to adjust the desired trajectory of the borehole 40.

With continued reference to FIG. 1, it will be appreciated that the drill string 30, and the column of drilling fluid located therein, provides a physical medium for communicating information from the surface to directional drilling tool 100. As described in more detail below, both the rotation rate of drill string 30 and the flow rate of the drilling fluid in the drill string 30 have been found to be reliable carriers of information from the surface to downhole. Although changes in rotation rate and flow rate may take time to traverse several thousand meters of drill pipe, the relative waveform characteristics of pulses including encoded data and/or commands are typically reliably preserved. For example, a sequence of rotation rate pulses has been found to traverse the drill string with sufficient accuracy to generally allow both rotation rate and relative time relationships within the sequence to be utilized to reliably encode data and/or commands.

Embodiments of this invention may utilize substantially any transmission system 60 for controlling the rotation rate of drill string 30 and the flow rate of drilling fluid in the drill string 30. For example, transmission system 60 may employ manual control of the rotation rate and/or flow rate, for example via known rheostatic control techniques. On drilling rigs including such manual control mechanisms, rotation rate and flow rate encoded data in accordance with this invention may be transmitted by manually adjusting the rotation and/or flow rates, e.g., in consultation with a timer. Alternatively, transmission system 60 may employ computerized control of the rotation rate and/or flow rate. In such systems, an operator may input a desired rotation rate and/or flow rate via a suitable user interface such as a keyboard or a touch screen. In one advantageous embodiment, transmission system 60 may include a computerized system in which an operator inputs the data and/or the command to be transmitted. For example, for a downhole steering tool, an operator may input desired tool face and offset values (as described in more detail below). The transmission system 60 then determines a suitable sequence of rotation rate and flow rate changes and executes the sequence to transmit the data and/or commands to the tool 100.

Figure 2:
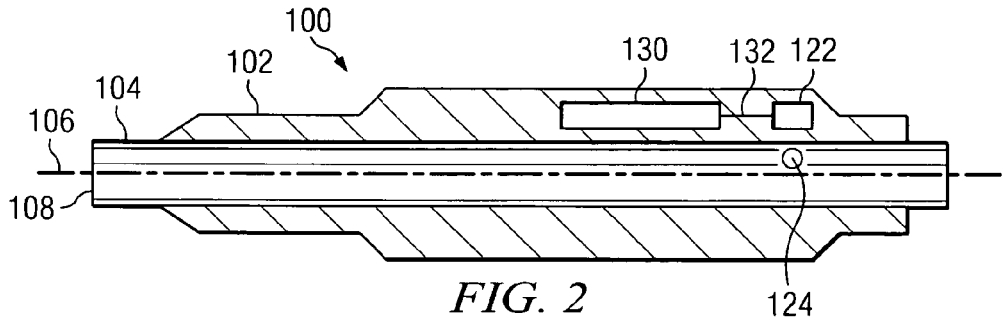
FIG. 2 depicts one exemplary embodiment of a downhole tool that may be utilized in accordance with the present invention.

With further reference now to FIG. 2, one exemplary embodiment of directional drilling tool 100 is schematically illustrated. Drilling tool 100 includes a substantially non-rotating housing 102, which, in this exemplary embodiment includes blades 110 (not shown on FIG. 2) that bear against the borehole wall 42 and thus substantially prevent the housing 102 from rotating with the drill string 30. A drive shaft 104 is rotatable within the housing 102 about the longitudinal axis 106 of the tool 100. Looking at FIGS. 1 and 2, one end 108 of the drive shaft 104 is typically coupled to the drill string 30 and rotates therewith.

As described above with respect to FIG. 1, directional drilling tool 100 may include sensors 120 (not shown on FIG. 2) for measuring the rotation rate of the drill string 30 and the flow rate of drilling fluid in the drill string 30. Substantially any sensor arrangement may be utilized. In the exemplary embodiment shown on FIG. 2, directional drilling tool 100 includes a rotation sensor 122 disposed in housing 102 to sense a marker 124 located on the drive shaft 104 as it rotates past the sensor 122. It will be understood that such an embodiment measures the rotation of the drive shaft relative to the housing 102. In embodiments in which the housing 102 is substantially non-rotating, such measurements may often accurately approximate the rotation rate of the drill string relative to the borehole. Alternative embodiments may locate the rotation sensor 122 on the drive shaft 104 and the marker 124 on the non-rotating housing 102. Marker 124 may include, for example, a magnet and rotation sensor 122 may include a Hall effect sensor. Alternatively, the rotation sensor 122 may include an infra-red sensor configured to sense a marker 124 including, for example, a mirror reflecting light from a source located near the sensor 122. An ultrasonic sensor may also be employed with a suitable marker. It will be appreciated that multiple markers 124 may optionally be deployed around the periphery of drive shaft 104 to increase the resolution (and thus precision of recognition) of the rotation measurements.

It has been found in certain applications (particularly when the drill bit 32 is off bottom) that a "non-rotating" housing sometimes rotates relative to the borehole. The rotation of the housing is typically at a lower rate than that of the drive shaft, but may, in some instances, be significant. In such instances, it may be advantageous to measure the rotation of both the drive shaft relative to the housing (as described above in the preceding paragraph) and the housing relative to the borehole. The sum of (or the difference between) the two rotation rates may then be taken as the rotation rate of the drill string. Substantially any known technique may be utilized for measuring the rotation rate of the housing. For example, a device that senses changes in centrifugal force may be used to determine the rotation rate of the housing. Alternatively, a terrestrial reference, such as gravity or the Earth's magnetic field, may be measured, for example, using tri-axial accelerometers, tri-axial magnetometers, and/or gyroscopes.

It will be appreciated that this invention may also be employed in downhole tools that are rotationally coupled with the drill string 30. In such embodiments, substantially any known technique may be utilized to measure rotation rate, such as a measurement of a terrestrial reference as described above.

Sensors 120 (FIG. 1) may also include a flow rate sensor, such as a turbine or an impellor disposed in the flow of drilling fluid. In such an embodiment, the impeller may output an electrical signal (e.g., a voltage) proportional to its rotation rate in the stream of drilling fluid (which may, for example, be substantially proportional to the flow rate).

Alternatively, sensors 120 may include a flow switch (e.g., a pressure sensor) that senses when the flow of drilling fluid has been turned on and off. The artisan of ordinary skill will readily recognize that such flow rate sensors and/or switch may be disposed elsewhere in the drill string 30. For example, flow rate sensors and/or switches are sometimes utilized in MWD survey tools 150.

With continued reference to FIG. 2, directional drilling tool 100 further includes a controller 130 having a programmable processor such as a microprocessor or a microcontroller and processor-readable or computer-readable programming code embodying logic, including instructions for controlling the function of the directional drilling tool 100. Controller 130 is disposed to receive rotation and flow rate encoded commands and to cause the tool 100 to execute such commands. In the exemplary embodiment shown, controller 130 is in electronic communication with rotation sensor 122 and is configured to measure the rotation rate of the drive shaft 204 to receive rotation-encoded data from the surface. For example, controller 130 may receive a pulse each time marker 124 rotates by sensor 122. Controller 130 may then calculate the rotation rate, for example, based upon the time interval between sequential pulses. Although not shown on FIG. 2, controller 130 may also be disposed to receive flow rate and/or pressure, for example, from MWD sensor 150 (FIG. 1).

A suitable controller 130 typically includes a timer and electronic memory such as volatile or non-volatile memory. The timer may include for example, an incrementing counter, a decrementing time-out counter, or a real-time clock. Controller 130 may further include a data storage device, various sensors, other controllable components, a power supply, and the like. Controller 130 may also include conventional receiving electronics, for example for receiving and amplifying pulses from sensor 122. Controller 130 may also optionally communicate with other instruments in the drill string, such as telemetry systems that communicate with the surface. It will be appreciated that controller 130 is not necessarily located in directional drilling tool 100, but may be disposed elsewhere in the drill string in electronic communication with directional drilling tool 100. Moreover, one skilled in the art will readily recognize that the multiple functions performed by the controller 130 may be distributed among a number of devices.

Figure 3A:
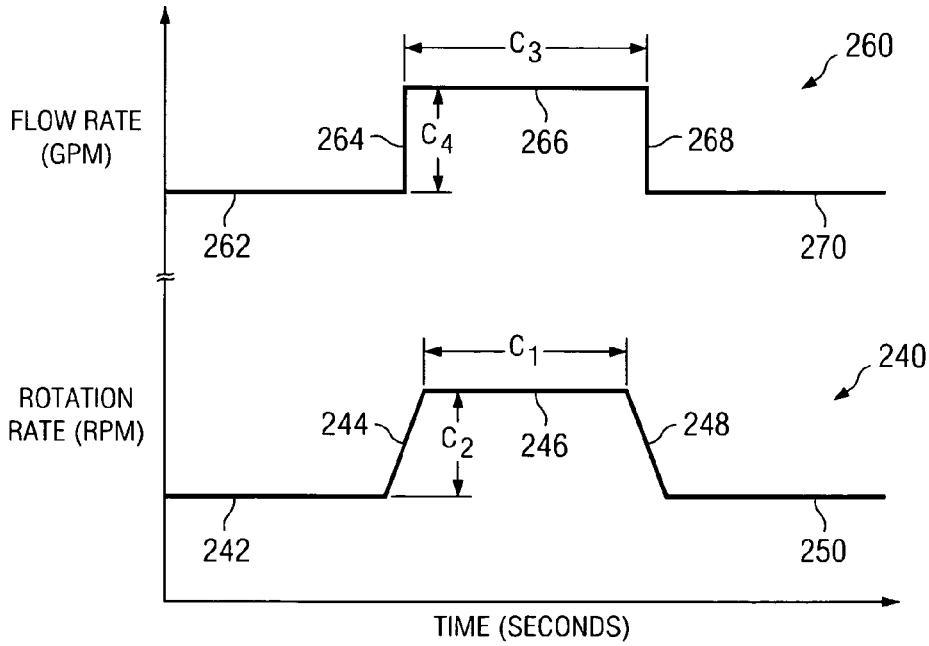
FIGS. 3A and 3B depict exemplary waveforms representing drilling fluid flow rate and drill string rotation rate encoding in accordance with the present invention.
Figure 3B:
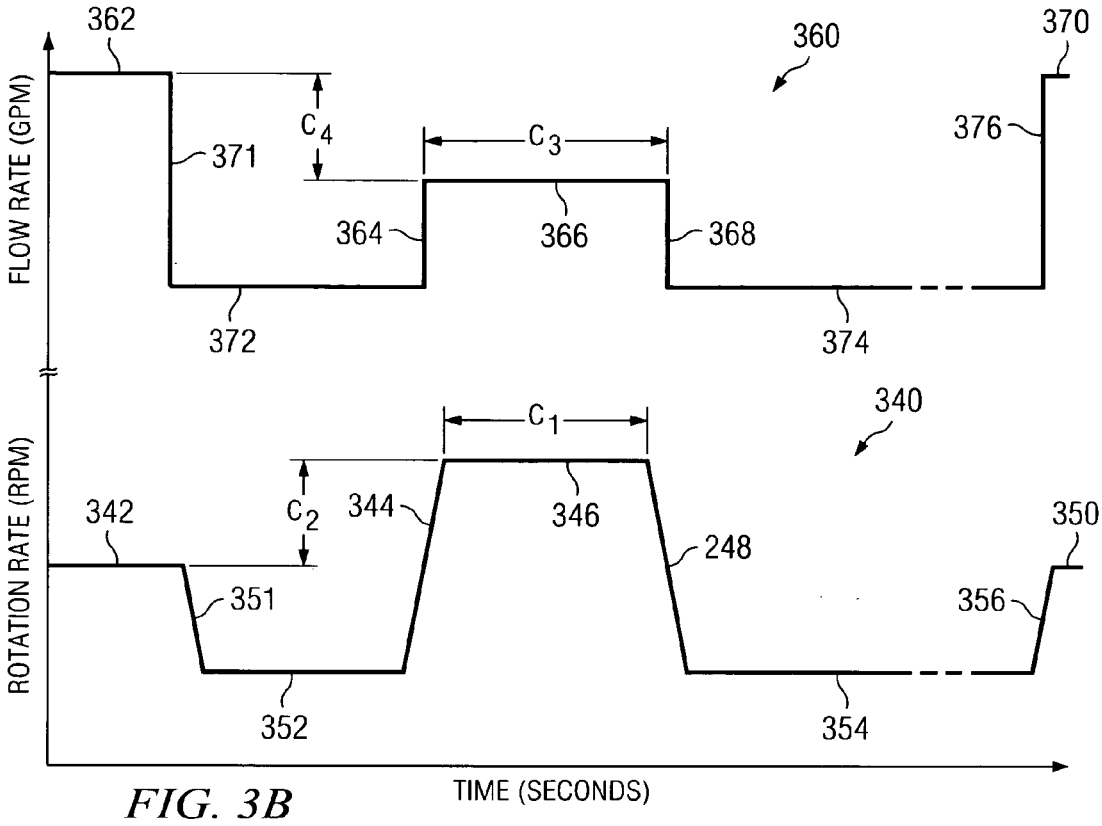
Figure 4:
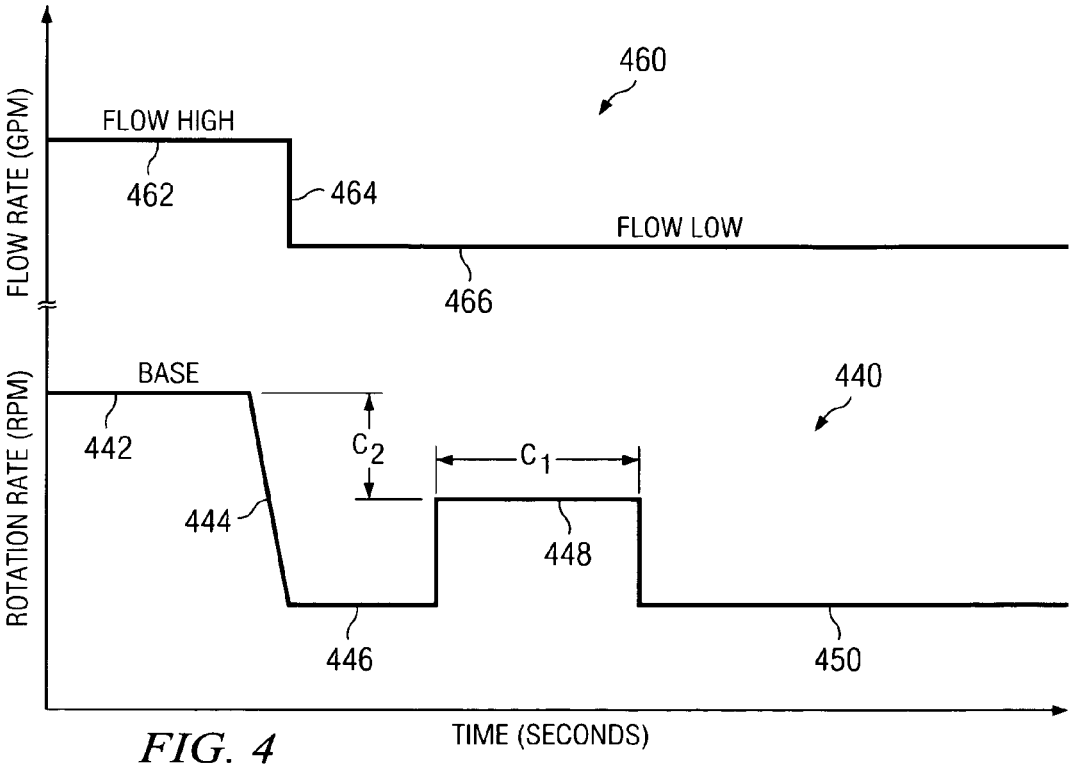
FIG. 4 depicts other exemplary waveforms representing drilling fluid flow rate and drill string rotation rate encoding in accordance with the present invention.

Reference should now be made to FIGS. 3A through 4. Certain exemplary encoding schemes, consistent with the present invention, encode data as a combination of a predefined sequence of varying rotation rates of a drill string and varying flow rates of the drilling fluid in the drill string. Such a sequence is referred to herein as a "code sequence." The encoding scheme may define one or more codes (e.g., data or tool commands) as a function of one or more measurable parameters of a code sequence, such as the rotation rates and/or flow rates at predefined times in the code sequence as well as the duration of predefined portions of the code sequence. In certain advantageous embodiments, various codes may be predefined as a function of (i) a change in rotation rate between predefined portions of the code sequence, (ii) a change in flow rate between predefined portions of the code sequence, and (iii) the duration of at least one predefined portion of the code sequence. One advantage of using a combination of rotation rate and flow rate encoding (as well as the duration of at least one predefined portion of the code sequence) is that more data and/or commands may be transmitted downhole per unit time, thereby potentially saving valuable rig time. Moreover, the accuracy of transmission may be increased since a smaller number of unique parameter levels (or ranges) are required for each parameter. For example only, an encoding scheme including four parameters (e.g., rotation rate, flow rate, and two duration parameters) each having only three levels, provides 81 unique combinations for encoding data and/or commands. If each parameter has four levels, 256 unique levels are provided.

Various alternative exemplary embodiments of encoding schemes, in accordance with the present invention, are described, in conjunction with FIGS. 3A through 4. FIGS. 3A through 4 show waveforms 240, 260, 340, 360, 440, and 460, each of which represent exemplary embodiments of rotation rate and flow rate encoded data. The vertical scale indicates the rotation rate of the drill string (e.g., measured in rotations per minute (RPM)) and the flow rate of the drilling fluid in the drill string (e.g., measured in gallons per minute (GPM)). The horizontal scale indicates relative time in seconds measured from an arbitrary reference.

One aspect of each of the exemplary encoding schemes described in conjunction with FIGS. 3A through 4 is the establishment of a base rotation rate and/or a base flow rate, however the invention is not limited to the establishment of such base rotation and flow rates. The use of base rotation and/or base flow rates advantageously enables data to be transmitted downhole without significant interruption of the drilling operation. Base rotation and/or flow rates may be established, for example, when the rotation and/or flow rate are constant (e.g., within about 10 to 20 percent) for at least a predefined period of time (e.g., 60 seconds). In addition, after a base rotation and/or flow rate is established, it may be invalidated whenever the rotation and/or flow sequence is detected to be inconsistent with the employed encoding scheme. For example, a decoder may determine that a divergence from the base rotation and/or flow rate is not consistent with a predefined code sequence. The decoder then returns the system to a state where it waits for base rotation and/or flow rates to be established.

Turning now to FIG. 3A, one exemplary embodiment of rotation rate and flow rate encoded data is represented by rotation rate waveform 240 and flow rate waveform 260, each of which is in the form of a base rate 242, 262 followed by a single pulse and a return to the base rate. A pulse in this exemplary embodiment is predefined as an increase 244, 264 from a relatively low base level 242, 262 to a relative high pulse level 246, 266 for at least a specified period of time, followed by a return 248, 268 to the relatively low base level 250, 270. The invention is, of course, not limited in this regard. Pulses including a decrease from a relatively high base level may likewise be utilized. Moreover, a suitable pulse may not necessarily require a return to the base level 242, 262.

In the exemplary embodiment shown on FIG. 3A, each pulse provides two parameters for encoding data (the duration and magnitude of the pulse). Waveform 240 includes a first code $C_1$ that is defined as a function of the measured duration of the rotation rate pulse and a second code $C_2$ that is defined as a function of the difference between the rotation rate at the elevated level 246 and the base level 242. Waveform 260 includes a first code $C_3$ that is defined as a function of the measured duration of the flow rate pulse and a second code $C_4$ that is defined as a function of the difference between the flow rate at the elevated level 266 and the base level 262. In alternative embodiments, substantially any number of suitable codes may be included in each waveform. Alternative embodiments may also define one or more codes as a function of duration and absolute value of the rotation and/or flow rates. Further alternative embodiments may include a plurality of sequential pulses including substantially any number of codes.

It will be appreciated that numerous code sequence validation checks may be utilized to determine the validity of waveforms 240 and 260. For example, each pulse may require an increase of at least a certain degree within a predetermined time limit to be considered a valid pulse (e.g., an increase of at least 20 rpm at 244 within 30 seconds for waveform 240). The rotation rate 246 and flow rate 266 may also be required to remain essentially constant (e.g., within about 20 rpm for waveform 240) for the entire duration of the pulse. Moreover, validity (or invalidity) may also be determined via duration measurements. For example, in certain embodiments, a valid sequence only occurs when $C_1$ is approximately equal to $C_3$ (e.g., within about 20 seconds). Additionally, pulses having durations that are either too short or too long may be discarded (e.g., less than 60 seconds and greater than 180 seconds). In still other exemplary embodiments, pulses 246 and 266 may be predefined to start and/or end at substantially the same time (e.g., within about 10 seconds of one another). The invention is not limited to the above described exemplary validation checks.

It will also be appreciated that numerous factors may be considered in determining the duration of a pulse (or some other feature of a code sequence). Such factors include, for example, the resolution of the rotation and/or flow rate measurements, the range of valid rotation and/or flow rates, the amount of time required to obtain accurate rotation and/or flow rate measurements, the accuracy of the encoding mechanism, the changes in duration in a particular sequence due to propagation of the rotation and/or fluid flow through the drill string, and the required accuracy of the decoding mechanism. A particular scheme may delineate the interval for measuring the duration of a pulse in any one of a variety of ways. For example, the duration of a pulse may be defined as the time interval between an increase of a predefined amount above the base level 242, 262 and a return to that base level 250, 270 (within predefined limits). Alternatively, the duration may be begin when the when the elevated level 246, 266 is achieved and end when the rotation rate or flow rate decreases below that level. Again, the invention is not limited in these regards.

Turning now to FIG. 3B, another exemplary embodiment of rotation rate and flow rate encoded data is represented by rotation rate waveform 340 and flow rate waveform 360. Waveforms 340 and 360 are similar to waveforms 240 and 260 shown on FIG. 3A in that they each include a pulse. Waveforms 340 and 360 differ from waveforms 240 and 260 in that after base rates 342, 346 are achieved, the rotation and flow rates are reduced 351, 371 to near zero 352, 372 levels for at least a predetermined time prior to initiation of the pulses at 344 and 364. In this manner the code sequence may be further validated, which may be advantageous in applications having significant noise (e.g., in the presence of stick/slip conditions, as described in the Background Section above). In this exemplary embodiment a pulse is defined as an increase 344, 364 from the near zero level 352, 372 to an elevated level 346, 366 for at least a specified period of time, followed by a decrease 348, 368 to the near zero level 354, 374. After returning to the near zero level 354, 374, waveforms 340 and 360 may include substantially any number of additional pulses prior to returning 356, 376 to near base levels 350, 370. It will be appreciated, that the waveforms 340, 360 need not necessarily return to the base levels at 350 and 370. Again, the invention is not limited in these regards.

In the exemplary embodiment shown on FIG. 3B, each pulse also provides two parameters for encoding data (the duration and magnitude of the pulse). Waveform 340 includes a first code $C_1$ that is defined as a function of the measured duration of the rotation rate pulse and a second code $C_2$ that is defined as a function of the difference between the rotation rates at the elevated level 346 and the base level 342. Waveform 360 includes a first code $C_3$ that is defined as a function of the measured duration of the flow rate pulse and a second code $C_4$ that is defined as a function of the difference between the flow rate at the elevated level 366 and the base level 362.

It will be appreciated that in certain applications and/or utilizing certain downhole tool combinations, direct measurement of drilling fluid flow rates may not be possible. Nevertheless, in such embodiments, a combination of rotation rate and flow rate encoding is possible. Turning now to FIG. 4, one such embodiment of rotation rate and flow rate encoded data is represented by rotation rate waveform 440 and flow rate waveform 460. In this exemplary embodiment, flow rate waveform 460 is a binary waveform in that it includes first 462 and second 466 levels (e.g., high and low or non-zero and zero flow). Waveform 460 may be measured, for example, with a drilling fluid pressure sensor deployed in the drill string. Relatively high pressure may correspond to high flow while relatively low pressure may correspond to low (or zero) flow. Waveform 440 is similar to wave form 340 (FIG. 3B) in that it includes a base rotation rate 442 followed by a decrease 444 to a near zero 446 rotation rate followed by a pulse 448 and a return to a near zero rotation rate 450. Waveform 440 may also include substantially any number of sequential pulses.

In the exemplary embodiment shown on FIG. 4, flow rate waveform 460 provides a validity check, with valid commands encoded only during times of low flow 466. In one serviceable embodiment of this invention, a base rotation rate 442 is achieved as described below. Following a decrease 444 in the rotation rate to some predetermined level 446 (e.g., near zero), a decrease 464 in flow rate indicates a valid code sequence. Waveform 440 provides first and second codes $C_1$ and $C_2$ that are respectively defined as a function of the measured duration of the rotation rate pulse and the difference between the rotation rates at level 448 and the base level 442. A second rotation rate pulse may provide third and fourth codes (not shown) or alternatively, a second command. It will be appreciated that binary flow waveform 440 is not necessarily restricted to verification of the code sequence, but may also include encoded binary pulses (not shown) timed, for example, to coincide with the rotation rate pulses.

Exemplary encoding schemes of this invention (such as that shown on FIG. 4) may advantageously be utilized, for example, after adding a new section of drill pipe to the drill string. In a typical drilling operation, rotation of the drill string and flow of the drilling fluid are turned off just prior to adding a new pipe section to the drill string. The flow is then typically turned back on to receive an MWD survey. In exemplary embodiments of this invention, base rotation rate 442 may be obtained prior to turning off the rotation of the drill string. After receiving the MWD survey (and determining, for example, whether or not a change in drilling direction is warranted), the drilling fluid may again be turned off, signaling the downhole tool of an incoming command. A relative change in drilling direction may then be transmitted via encoding one or more rotation rate pulses as described in more detail below. After turning the flow of drilling fluid back on, drilling may then commence.

One exemplary encoding scheme of the present invention is now described in more detail with respect to TABLES 1 through 4 and FIGS. 1, 2, and 4. The exemplary encoding scheme enables a drilling operator to control a directional drilling tool (e.g., steering tool 100 shown on FIGS. 1 and 2). Directional commands may be transmitted from the surface to the tool 100, thereby programming the trajectory of a borehole as it is being drilled. In the exemplary embodiment shown in TABLES 1 through 4, the commands include relative changes to the current tool face and offset settings, although the invention is not limited in this regard. Nor is the invention limited in any way by the particular commands shown in TABLES 1 through 4.

Offset and tool face, as used herein, refer to the magnitude (typically in inches) and direction (typically in degrees relative to high side) of the eccentricity of the steering tool axis from the borehole axis. Such eccentricity tends to alter an angle of approach of a drill bit and thereby change the drilling direction. The magnitude and direction of the offset are typically controllable, for example by controlling the relative radial positions of the steering tool blades. In general, increasing the offset (i.e., increasing the distance between the tool axis and the borehole axis) tends to increase the curvature (dogleg severity) of the borehole upon subsequent drilling. Moreover, in a "push the bit" configuration, the direction (tool face) of subsequent drilling tends to be the same (or nearly the same depending, for example, upon local formation characteristics) as the direction of the offset between the tool axis and the borehole axis. For example, in a push the bit configuration a steering tool offset at a tool face of about 90 degrees (relative to high side) tends steer the drill bit to the right upon subsequent drilling. The artisan of ordinary skill will readily recognize that in a "point the bit" configuration, the direction of subsequent drilling tends to be in the opposite direction as the tool face (i.e., to the left in the above example). It will be appreciated that the invention is not limited to the above described steering tool embodiments.

Referring again to TABLES 1 through 4, relative changes to the current tool face and offset settings are encoded based upon unique combinations of codes $C_1$ and $C_2$ shown on FIG. 4. In this exemplary embodiment code $C_1$ has four unique levels while code $C_2$ has three unique levels. The duration of the rotation rate pulse (code $C_1$) determines from which of TABLES 1 through 4 the differential tool command is obtained. The difference between the pulse and base rotation rate levels (code $C_2$) is then utilized to determine the particular command (e.g., the relative change to the current tool face or offset setting). For example, TABLE 1 is utilized when code $C_1$ is in the range from 30 to 60 seconds. If the pulse rotation rate is within about 20 rpm of the base rotation rate (i.e., $-20 \leqq C_2 \leqq 20$) the tool offset is set to 0 degrees. TABLE 2 is utilized when code $C_1$ is in the range from 60 to 90 seconds, while TABLE 3 is utilized when code $C_1$ is in the range from 90 to 120 seconds, and TABLE 4 is utilized when code $C_1$ is in the range from 120 to 150 seconds.

TABLE 1

| $30 \leqq C_1 < 60$ | |
|---|---|
| RPM Relationship (Pulse vs. Base) | Tool Command |
| $-20 \leqq C_2 < 20$ | Offset = 0 |
| $C_2 \geqq 20$ | UP |
| $C_2 < -20$ | DOWN |

TABLE 2

| $60 \leqq C_1 < 90$ | |
|---|---|
| RPM Relationship (Pulse vs. Base) | Tool Command |
| $-20 \leqq C_2 < 20$ | Offset = 0 |
| $C_2 \geqq 20$ | RIGHT |
| $C_2 < -20$ | LEFT |

TABLE 3

| $90 \leqq C_1 < 120$ | |
|---|---|
| RPM Relationship (Pulse vs. Base) | Tool Command |
| $-20 \leqq C_2 < 20$ | Fast Blade Collapse |
| $C_2 \geqq 20$ | Tool Face + 30 degrees |
| $C_2 < -20$ | Tool Face − 30 degrees |

TABLE 4

| $120 \leqq C_1 < 150$ | |
|---|---|
| RPM Relationship (Pulse vs. Base) | Tool Command |
| $-20 \leqq C_2 < 20$ | HOLD/CRUISE |
| $C_2 \geqq 20$ | Offset + 0.1 inch |
| $C_2 < -20$ | Offset − 0.1 inch |

Referring now to TABLE 1, an UP command is executed when the rotation rate of the pulse is at least 20 rpm greater than the base rotation rate (i.e., $C_2 \geqq 20$). A DOWN command is executed when the rotation rate of the pulse is at least 20 rpm less than the base rotation rate (i.e., $C_2 < -20$). The UP and DOWN commands refer to relative changes to the current tool face setting. UP refers to a rotation of the tool face about the horizontal axis (i.e., the 90–270 degree axis) to the upper quadrants. DOWN refers to a rotation of the tool face about the horizontal axis (i.e., the 90–270 degree axis) to the lower quadrants. For example, if the current tool face is 30 degrees (relative to high side), an UP command leaves the tool face unchanged since it is already in one of the upper quadrants. A DOWN command rotates the tool face symmetrically about the horizontal axis from 30 degrees to 150 degrees. In another example, if the current tool face is 225 degrees, an UP command rotates the tool face symmetrically about the horizontal axis from 225 degrees to 315 degrees (i.e., −45 degrees). A DOWN command leaves the tool face unchanged since it is already in the one of the lower quadrants.

Turning now to TABLE 2, a RIGHT command is executed when the rotation rate of the pulse is at least 20 rpm greater than the base rotation rate (i.e., $C_2 \geqq 20$). A LEFT command is executed when the rotation rate of the pulse is at least 20 rpm less than the base rotation rate (i.e., $C_2 < -20$). The RIGHT and LEFT commands refer to relative changes to the current tool face setting. RIGHT refers to a rotation of the tool face about the vertical axis (i.e., the 0–180 degree axis) to the right quadrants. LEFT refers to a rotation of the tool face about the vertical axis (i.e., the 0–180 degree axis) to the left quadrants. For example, if the current tool face is 30 degrees (relative to high side), a RIGHT command leaves the tool face unchanged since it is already in one of the right quadrants. A LEFT command rotates the tool face symmetrically about the vertical axis from 30 degrees to 330 degrees (i.e., −30 degrees). In another example, if the current tool face is 225 degrees, a RIGHT command rotates the tool face symmetrically about the vertical axis from 225 degrees to 135 degrees. A LEFT command leaves the tool face unchanged since it is already in the one of the left quadrants.

With reference now to TABLE 3, when the rotation rate of the pulse is within 20 rpm of the base rotation rate, a fast blade collapse command is executed. This command fully retracts each of the steering tool blades, for example, in preparation of removing the tool from the borehole. When the rotation rate of the pulse is at least 20 rpm greater than the base rotation rate (i.e., $C_2 \geqq 20$), the current tool face setting is increased by 30 degrees. Upon receipt of such a command, a tool face of 45 degrees, for example, is increased to 75 degrees. When the rotation rate of the pulse is at least 20 rpm less than the base rotation rate (i.e., $C_2 < -20$), the current tool face setting is decreased by 30 degrees. Upon receipt of such a command, a tool face of 45 degrees, for example, is decreased to 15 degrees.

Referring now to TABLE 4, when the rotation rate of the pulse is within 20 rpm of the base rotation rate, a HOLD or CRUISE command is executed. A HOLD command instructs the steering tool to maintain the current inclination of the borehole and in this exemplary embodiment is only executed when the current tool face is 0 degrees. A CRUISE command instructs the steering tool to maintain both the current inclination and the current azimuth. The CRUISE command is executed when the current tool face is not equal to 0 degrees. When the rotation rate of the pulse is at least 20 rpm greater than the base rotation rate (i.e., $C_2 \geqq 20$), the current offset setting is increased by 0.1 inches. Upon receipt of such a command, an offset of 0.2 inches, for example, is increased to 0.3 inches. When the rotation rate of the pulse is at least 20 rpm less than the base rotation rate (i.e., $C_2 < -20$), the current offset is decreased by 0.1 inches. Upon receipt of such a command, an offset of 0.2 inches is decreased to 0.1 inches.

As stated above, multiple commands may be transmitted downhole via encoding two or more pulses. For example, in order to change both the tool face and offset, a first pulse may be utilized to change the tool face and a second pulse may be utilized to change the offset. In other instances, multiple pulses may be utilized to change the tool face or offset settings. For example, in the exemplary embodiment shown in TABLES 1 through 4, first and second consecutive pulses may be utilized to increase the offset by a total of 0.2 inches by causing each pulse to increase the offset by 0.1 inch. In another example, the tool face may be changed from 45 degrees to 225 degrees by first transmitting a DOWN command and then transmitting a LEFT command. It will be understood that the invention is not limited by such examples, which are disclosed here for purely illustrative purposes. The artisan of ordinary skill will readily recognize that numerous command combinations may be utilized to program a particular change in tool face and offset settings. Moreover, the invention is not limited to the exemplary commands shown on TABLES 1 through 4.

It will be appreciated that the use of a differential encoding method, such as that described above with respect to TABLES 1 through 4, in which a relative change in current tool face and/or offset settings is encoded may be advantageous for some applications. Such a differential approach may reduce the amount of information required to be encoded, and therefore may reduce the time required to transmit a command downhole, as compared to prior art methods that directly encode the tool face and offset settings. Often it is desirable to make small changes to the drilling direction, for example, due to drift from a desired course. Exemplary embodiments of this invention are well suited for making such small changes, for example, by increasing or decreasing the tool face or the offset settings. Such small changes may often be advantageously encoded in a single pulse, which saves valuable rig time. Prior art approaches that directly encode the tool face and offset settings may require as many as three pulses to encode new tool face and offset. Moreover, since exemplary embodiments of this invention require fewer distinct commands than certain methods of the prior art, fewer rotation rate levels are required to encode those commands. As such, exemplary embodiments of this invention may advantageously be utilized in applications in which accurate measurement of the rotation rate is sometimes problematic (e.g., due to stick slip problems).

Figure 5A:
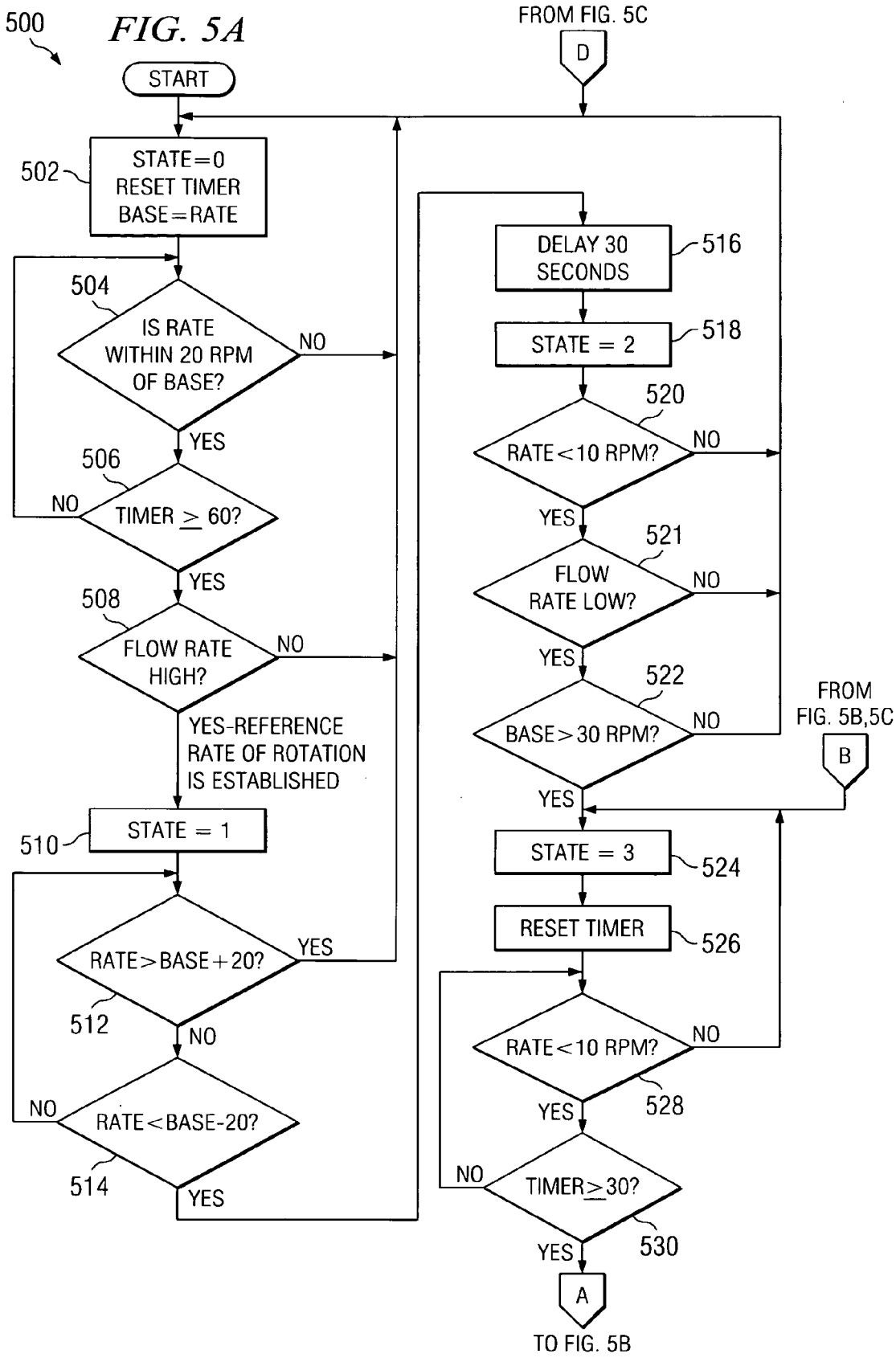
FIGS. 5A through 5C depict, in combination, a flow diagram illustrating one exemplary method embodiment in accordance with the present invention.
Figure 5B:
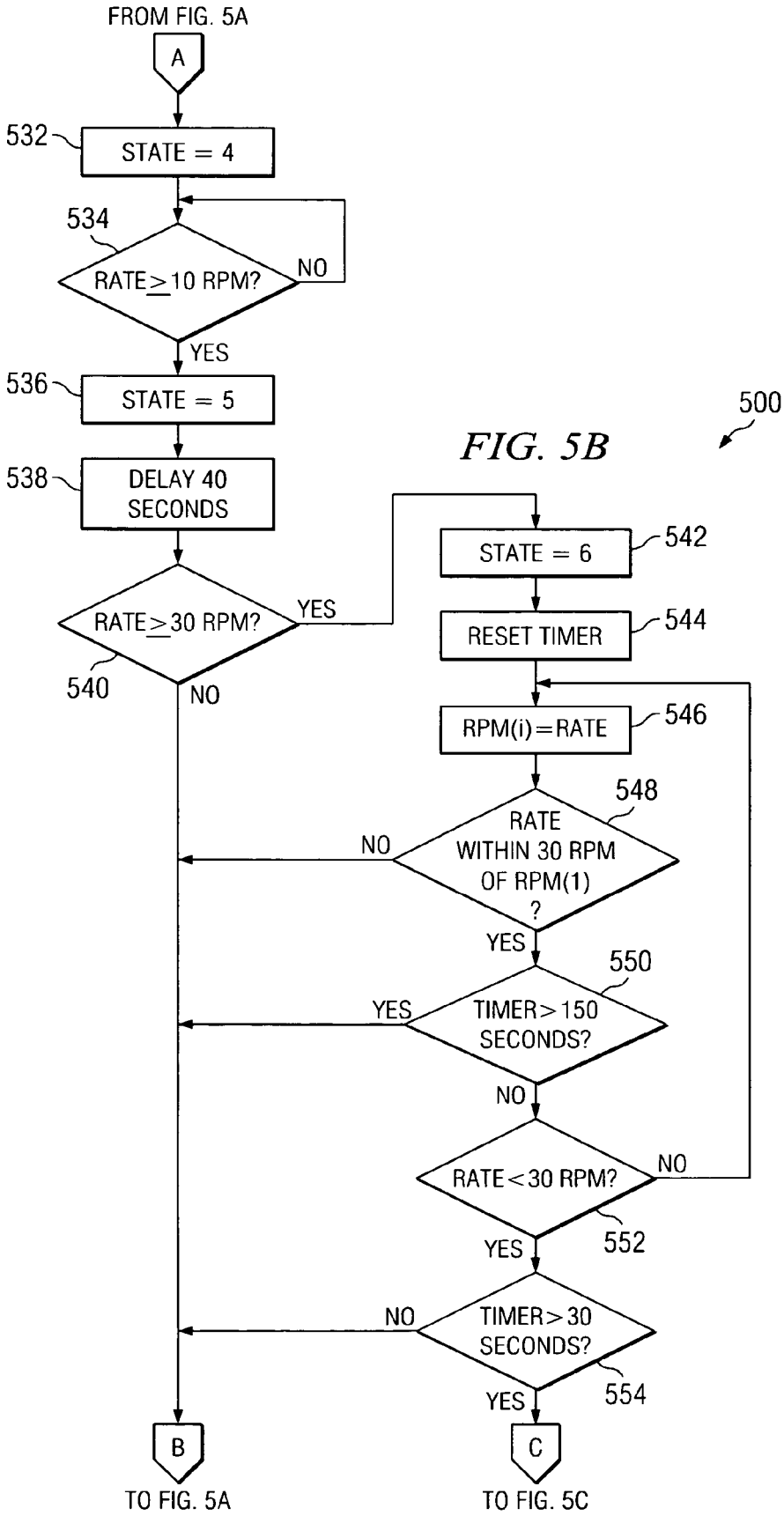
Figure 5C:
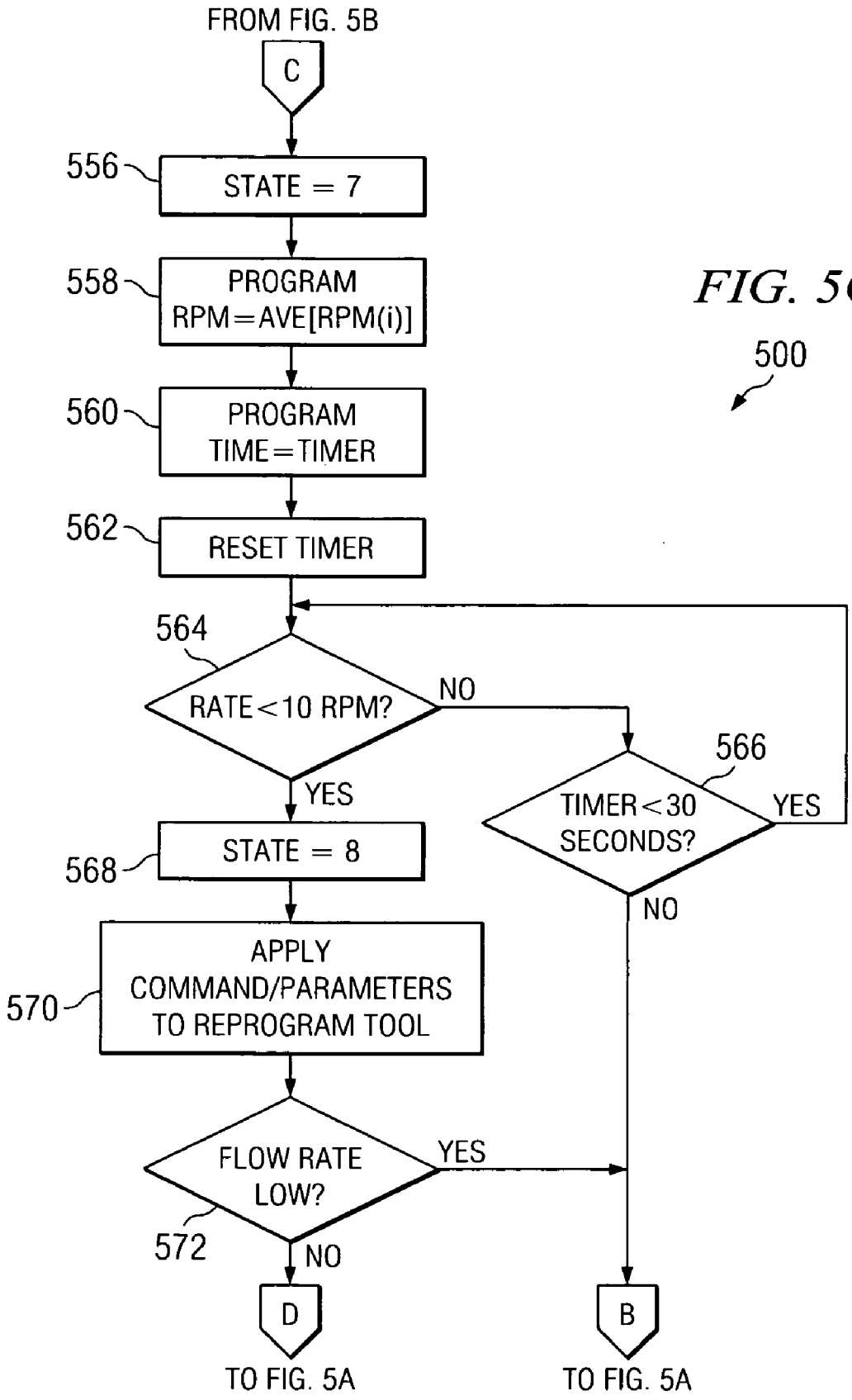

Referring now to FIGS. 5A through 5C a flow diagram of one exemplary method embodiment 500 for decoding rotation rate and flow rate encoded data in accordance with the present invention is illustrated. An exemplary controller, such as controller 130 shown on FIG. 2, is suitable to execute exemplary method embodiment 500. In the exemplary embodiment shown, the method is implemented as a state machine that is called once each second to execute a selected portion of the program to determine whether a change in state is in order. Method 500 is suitable to be used to decode code sequences compliant with the exemplary encoding scheme described in conjunction with Tables 1 through 4 described above. As described above, in this exemplary embodiment, the commands are embedded in a code sequence including a flow rate switch (e.g., from high to low flow) and at least one rotation rate pulse. As also described above, the invention is expressly not limited in these regards.

Method embodiment 500 utilizes a base rotation rate, which is established for this particular embodiment when the rotation rate of the drill string (e.g., drill string 30 shown on FIG. 1) is detected by the controller (e.g., controller 130 shown on FIG. 2) to maintain an essentially constant level, e.g., within plus or minus 20 RPM for 60 seconds. After a base rotation rate is established, it is invalidated whenever the detected rotation rate and flow rate sequence is found to be inconsistent with the employed encoding scheme.

With continued reference to the flow diagram of FIGS. 5A through 5C, "STATE", "RATE", "TIMER", "BASE", and "FLOW" refer to variables stored in local memory (e.g., in controller 130 shown on FIG. 2). Method embodiment 500 functions similarly to a state-machine with STATE indicating the current state. As the code sequence is received and decoded, STATE indicates the current relative position within an incoming code sequence. RATE represents the most recently measured value for the rotation rate of the drill string. In the exemplary embodiment shown, RATE is updated once each second by an interrupt driven software routine (running in the background) that computes the average rotation rate for the previous 20 seconds. This interrupt driven routine works in tandem with another interrupt driven routine (also running in the background) that is executed (with reference to FIG. 2), for example, each time sensor 122 detects marker 124 and determines the elapsed time since the previous instant the marker was detected. As described above, the elapsed time is then used to determine the rotation rate of the drill string. It will be appreciated that TIMER does not refer to the above described elapsed time, but rather to a variable stored in memory that records the time in seconds elapsed following the execution of certain predetermined method steps. In the exemplary embodiment shown, TIMER is updated once each second by a software subroutine. FLOW represents the most recent measured value for the flow rate (or alternatively pressure) of the drilling fluid. In this exemplary embodiment, FLOW is a binary variable, being either high or low.

With reference now to FIG. 5A, method 500 begins at 502 at which STATE is set to 0 to indicate that no base rotation rate is established, BASE is set to RATE (the most recently measured rotation rate), and TIMER is reset (to 0). At STATE 0, method 500 repeatedly checks to determine whether or not a base rotation rate has been established. In this exemplary embodiment, a base rotation rate is established when the rotation rate of the drill string is detected to be within 20 rpm of the base (at 504) for at least 60 seconds (at 506). If the rotation rate is determined to vary by more than 20 rpm the program returns to 502 and resets TIMER. If RATE is within 20 rpm of BASE for at least 60 seconds, the program checks the most recent value of FLOW at 508. If FLOW is high, a base rotation rate is established and the STATE is set equal to 1 at 510. If FLOW is low the program returns to 502.

At STATE 1 the program waits for a decrease in rotation rate below the base rate established in STATE 0. RATE is repeatedly sampled (e.g., once per second) at 512 and 514 to determine whether it changes from BASE. If RATE is determined at 512 to increase by at least 20 rpm over BASE, then the base rate is invalidated and the program returns to 502. If RATE is determined at 514 to decrease by at least 20 rpm below BASE, then the program waits 30 seconds at 516 before setting STATE equal to 2 at 518.

If a valid code sequence has been initiated, RATE decreases to less than 10 rpm and FLOW is switched from high to low during the 30 second delay. At 520 and 521 (when STATE equals 2) the program checks RATE and FLOW to determine whether these conditions are met. If either condition has not been met, the established base rate is invalidated and the program returns to 502. In this exemplary embodiment, FLOW is also periodically checked in the background. If FLOW is high at any time while STATE equals 3 through 8, the code sequence is invalidated and the program returns to 502 and sets STATE equal to 0. At 522 the program also checks that BASE is greater than 30 rpm. If BASE is greater than 30 rpm, STATE is set equal to 3 at 524. If BASE is less than 30 rpm an invalid base rotation rate has been established and the program returns to 502.

In a valid code sequence, the rotation rate remains below 10 rpm for at least 30 seconds prior to a rotation rate pulse. At STATE 3, TIMER is reset at 526 and the program checks RATE once per second at 528. If RATE is greater than 10 rpm, the program returns to 524 where STATE is again set equal to 3 and TIMER is reset. If rate is less than 10 rpm and TIMER is greater than or equal to 30 seconds at 530 (indicating that RATE has remained less than 10 rpm for at least 30 seconds), STATE is set equal to 4 at 532 (FIG. 5B).

With reference now to FIG. 5B, at STATE 4 the program awaits the initial rotation rate increase of a rotation rate pulse (as shown, for example, at 448 on FIG. 4). If RATE is greater than or equal to 10 rpm at 534, a rotation rate pulse is assumed to be detected and STATE is set equal to 5 at 536. If RATE is less than 10 rpm at 534 the program continues waiting for a pulse, checking RATE once per second at 534. In one exemplary embodiment, the program continues checking RATE until either the initial rotation rate of a pulse is detected (as indicated by a value of RATE greater than or equal to 10 rpm) or FLOW has been switched to low for more the 12 minutes (not shown). After FLOW has been switched low for more than 12 minutes the program returns to 502 and sets STATE equal to 0.

At STATE 5 the program waits 40 seconds for the RATE to average up at 538 and then checks that RATE is greater than 30 rpm at 540. In the exemplary embodiment shown, the rotation rate of a valid pulse is greater than 30 rpm. If RATE is less than 30 rpm at 540, an invalid pulse has been detected and the program returns to 524 and sets STATE equal to 3. If RATE is greater than or equal to 30 rpm at 540, STATE is set equal to 6 at 542.

At STATE 6 the program saves the rotation rate of the pulse each second, checks the validity of the pulse, and awaits the end of the pulse. At 544 TIMER is reset. At 546 RPM(i) is set equal to RATE. RPM(i) are saved to memory and represent rotation rate values measured each second during the duration of the pulse. At 548 the program checks that RATE is within plus or minus 30 rpm of RPM(1) (the first measured rate of the pulse). If not the pulse is invalidated and the program returns to 524 where STATE is set equal to 3 (FIG. 5A). At 550 if TIMER is greater than 150 seconds, the pulse is also invalidated and the program returns to 524. If the RATE decreases to less than 30 rpm at 552 and TIMER is greater than 30 seconds at 554 a valid pulse has been detected and the program sets STATE equal to 7 at 556 (FIG. 5C).

Turning now to FIG. 5C, STATE 7 computes PROGRAM RPM (the average rotation rate of the pulse) and PROGRAM TIME (the duration of the pulse) at 558 and 560. PROGRAM RPM and PROGRAM TIME are then utilized to determine an appropriate command as described above with respect to Tables 1 through 4. In STATE 7 the program makes one additional check of the validity of the rotation rate pulse at 562, 564, and 566. In the exemplary embodiment, the rotation rate decreases to less than 10 rpm within 30 seconds of decreasing below 30 rpm as determined at 552 (FIG. 5B). If RATE does not decrease below 10 rpm at 564 within 30 seconds at 566 the pulse is invalidated and the program returns to 524 where STATE is set equal to 3 (FIG. 5A). If RATE is less than 10 rpm at 564, STATE is set equal to 8 at 568.

At STATE 8 the command is applied at 570 to reprogram the tool. For example, in this exemplary embodiment, if the command is to increase the tool face by 30 degrees, then the tool is instructed to increase tool face by 30 degrees over its current setting. After application of the command at 570, the program checks FLOW at 572. If FLOW is high, the program returns to 502 and sets STATE equal to 0 (FIG. 5A). If FLOW is low, the program returns to 524 and sets STATE equal to 3 (FIG. 5A) at which time the program awaits another rotation rate pulse.

Although the present invention and its advantages have been described in detail, it should be understood that various changes, substitutions and alternations can be made herein without departing from the spirit and scope of the invention as defined by the appended claims.

We claim:

1. A method for communicating with a downhole tool deployed in a subterranean borehole, the method comprising:

(a) deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis, the drill string further including a flow measurement device operative to measure flow rates of drilling fluid in the drill string;

(b) predefining an encoding language comprising codes understandable to the downhole tool, the codes represented in said language as predefined value combinations of drill string rotation variables and drilling fluid flow variables, the drill string rotation variables including rotation rate, the drilling fluid flow variables including flow rate;

(c) causing the drill string to rotate at a preselected rotation rate;

(d) causing the drilling fluid to flow in the drill string at a preselected flow rate;

(e) causing the rotation measurement device to measure the rotation rate and the flow measurement device to measure the flow rate; and (f) processing downhole the rotation rate and the flow rate measured in (e) to acquire at least one code in said language at the downhole tool.

2. The method of claim 1, wherein the downhole tool comprises a steering tool including extendable and retractable blades, the blades being operative to control a direction of drilling of the subterranean borehole; and at least one of the codes includes a command, the command causing the directional drilling tool to extend at least one of the blades to a desired extended position.

3. The method of claim 2, wherein the command ordains the steering tool to achieve a predefined tool setting, the command including at least one selected from the group consisting of:

(1) absolute offset;

(2) absolute tool face;

(3) relative change of offset from current;

(4) relative change of tool face from current.

4. The method of claim 1, wherein:

the downhole tool comprises a substantially non-rotating housing deployed about a drive shaft that rotates with the drill string; and the rotation measurement device includes at least one marker deployed on the drive shaft and a sensor deployed on the substantially non-rotating housing, the sensor disposed to detect the at least one marker as it rotates by the sensor.

5. The method of claim 1, wherein the flow measurement device is selected from the group consisting of a turbine and an impeller.

6. The method of claim 1, wherein:

(c) further comprises causing the drill string to rotate at first and second preselected rotation rates;

(e) further comprises causing the rotation measurement device to measure the first and second rotation rates; and (f) further comprises processing downhole a difference between the first and second rotation rates measured in (e) to acquire the at least one code at the downhole tool.

7. The method of claim 6, wherein:

(c) further comprises causing the drill string to rotate through a predefined sequence of varying rotation rates, the sequence including the second rotation rate, the drill string rotation variables in (b) further including a duration of rotation during a predetermined portion of the sequence; and (f) further comprises processing the duration of rotation to acquire the at least one code at the downhole tool.

8. The method of claim 7, wherein the drill string is substantially non-rotating during a portion of the sequence of varying rotation rates.

9. The method of claim 6, wherein:

(d) further comprises causing the drilling fluid to flow in the drill string at first and second preselected flow rates; and (e) further comprises causing the flow measurement device to measure the first and second flow rates.

10. The method of claim 9, wherein the flow rate measured in (e) is measured as a binary variable including high and low flow levels; and the at least one code is acquired at the downhole tool in (f) when, and only when, the flow rate measured in (e) is detected to be at a preselected one of the high and the low flow levels.

11. The method of claim 9, wherein (f) further comprises processing a difference between the first and second flow rates to acquire the at least one code at the downhole tool.

12. The method of claim 11, wherein:

(d) further comprises causing the drill fluid to flow in a predefined sequence of varying flow rates, the sequence including the second flow rate, the drilling fluid flow variables in (b) further including a duration of flow during a predetermined portion of the sequence; and (f) further comprises processing the duration of flow to acquire the at least one code at the downhole tool.

13. The method of claim 1, further comprising:

(g) receiving, at the surface, sensor data acquired by a sensor deployed in the drill string; and (h) responsive to the sensor data received at the surface in (g), repeating (c), (d), (e), and (f), to acquire further codes in said language at the downhole device.

14. A method for communicating with a downhole tool deployed in a subterranean borehole, the method comprising:

(a) deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis;

(b) predefining an encoding language comprising codes understandable to the downhole tool, the codes represented in said language as predefined value combinations of drill string variables including drill string rotation variables, said drill string rotation variables including rotation rate;

(c) causing the drill string to rotate at a preselected rotation rate;

(d) causing the rotation measurement device to measure the rotation rate; and (e) processing downhole the rotation rate measured (d) to acquire at least one code in said language at the downhole tool, the downhole tool recognizing at least one of said acquired codes as a command to make a predetermined relative change to at least one of its current tool settings.

15. The method of claim 14, wherein:

the downhole tool comprises a steering tool; and said acquired codes in (e) are recognized as a command to make a predetermined relative change to at least one tool setting selected from the group consisting of (i) offset and (ii) tool face.

16. The method of claim 14, wherein the downhole tool comprises a steering tool having extendable and retractable blades, the blades being operative to control a direction of drilling of the subterranean borehole; and at least one of the codes includes a command, the command causing the steering tool to change an extended position of at least one of the blades.

17. The method of claim 14, wherein:

(c) further comprises causing the drill string to rotate through a predefined sequence of varying rotation rates, the sequence including first and second rotation rates, the drill string rotation variables in (b) including (i) a difference between the first and second rotation rates and (ii) a duration of rotation during a predetermined portion of the sequence; and (e) further comprises processing downhole (i) the difference between the first and second rotation rates and (ii) the duration to acquire the at least one code at the downhole tool.

18. A method for communicating with a downhole tool deployed in a subterranean borehole, the method comprising:

(a) deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis, the drill string further including a flow sensing device operative to measure flow of drilling fluid in the drill string;

(b) predefining an encoding language comprising codes understandable to the downhole tool, the codes represented in said language as predefined value combinations of drill string rotation variables and drilling fluid flow variables, the drill string rotation variables including rotation rate;

(c) causing the drill string to rotate at a preselected rotation rate;

(d) causing the drilling fluid to flow in the drill string at a preselected flow rate;

(e) causing the rotation measurement device to measure the rotation rate of the drill string;

(f) causing the flow sensing device to measure the flow of the drilling fluid, the flow measured as a binary variable including high and low flow levels; and (g) processing downhole the rotation rate measured in (e) and the flow measured in (f) to acquire at least one code in said language at the downhole tool, the at least one code acquired at the tool only when the flow measured in (f) is detected to be at a preselected one of the high and low flow levels.

19. The method of claim 18, wherein there is substantially no flow of drilling fluid in the drill string at the low flow level.

20. The method of claim 18, wherein the flow sensing device comprises a drilling fluid pressure sensor.

21. The method of claim 18, wherein the downhole tool comprises a steering tool including extendable and retractable blades, the blades being operative to control a direction of drilling of the subterranean borehole; and at least one of the codes includes a command, the command causing the directional drilling tool to extend at least one of the blades to a desired extended position.

22. The method of claim 21, wherein the command ordains the steering tool to achieve a predefined tool setting, the command including at least one selected from the group consisting of:

(1) absolute offset;

(2) absolute tool face;

(3) relative change of offset from current;

(4) relative change of tool face from current.

23. The method of claim 18, wherein:

(c) further comprises causing the drill string to rotate at first and second preselected rotation rates;

(e) further comprises causing the rotation measurement device to measure the first and second rotation rates; and (f) comprises processing downhole a difference between the first and second rotation rates measured in (e) to acquire the at least one code at the downhole tool.

24. The method of claim 23, wherein:

(c) further comprises causing the drill string to rotate through a predefined sequence of varying rotation rates, the sequence including the second rotation rate, the drill string rotation variables in (b) further including a duration of rotation during a predetermined portion of the sequence; and (f) further comprises processing the duration of rotation to acquire the at least one code at the downhole tool.

25. A method for communicating with a downhole steering tool deployed in a subterranean borehole, the method comprising:

(a) deploying a drill string in a subterranean borehole, the drill string including a downhole tool connected thereto, the drill string being rotatable about a longitudinal axis, the drill string including a rotation measurement device operative to measure rotation rates of the drill string about the longitudinal axis, the drill string further including a flow sensing device operative to measure flow of drilling fluid in the drill string;

(b) predefining an encoding language comprising codes understandable to the downhole tool, the codes represented in said language as predefined value combinations of drill string rotation variables and drilling fluid flow variables, the drill string rotation variables including rotation rate;

(c) causing the drill string to rotate at a preselected rotation rate;

(d) causing the drilling fluid to flow in the drill string at a preselected flow rate;

(e) causing the rotation measurement device to measure the rotation rate of the drill string;

(f) causing the flow sensing device to measure the flow of the drilling fluid, the flow measured as a binary variable including high and low flow levels; and (g) processing downhole the rotation rate measured in (e) and the flow measured in (f) to acquire at least one code in said language at the downhole tool, the at least one code acquired at the tool only when the flow measured in (f) is detected to be at a preselected one of the high and low flow levels, the downhole tool recognizing at least one of said acquired codes as a command to make a predetermined relative change to at least one of its current tool settings.

26. The method of claim 25, wherein said acquired codes in (g) are recognized as a command to make a predetermined relative change to at least one tool setting selected from the group consisting of (i) offset and (ii) tool face.

27. The method of claim 25, wherein the steering tool comprises extendable and retractable blades, the blades being operative to control a direction of drilling of the subterranean borehole; and at least one of the codes includes a command, the command causing the steering tool to change an extended position of at least one of the blades.

28. The method of claim 25, wherein there is substantially no flow of drilling fluid in the drill string at the low flow level.

29. The method of claim 25, wherein:

(c) further comprises causing the drill string to rotate through a predefined sequence of varying rotation rates, the sequence including a second rotation rate, the drill string rotation variables in (b) further including a duration of rotation during a predetermined portion of the sequence;

(e) further comprises causing the rotation measurement device to measure the first and second rotation rates; and (f) comprises processing downhole (i) a difference between the first and second rotation rates measured in (e) and (ii) the duration of rotation to acquire the at least one code at the steering tool.

30. The method of claim 29, wherein the drill string is substantially non-rotating during a portion of the sequence of varying rotation rates.

31. The method of claim 25, further comprising:

(h) receiving, at the surface, sensor data acquired by a sensor deployed in the drill string; and (i) responsive to the sensor data received at the surface in (g), repeating (c), (d), (e), (f), and (g) to acquire further codes in said language at the downhole device.

* * * * *